US008555842B2

(12) United States Patent
Janowiak

(10) Patent No.: US 8,555,842 B2
(45) Date of Patent: Oct. 15, 2013

(54) COLD-FORMED FLAT TOP PLUNGER FOR USE IN A HYDRAULIC LASH ADJUSTER AND METHOD OF MAKING SAME

(75) Inventor: Gary Janowiak, Saginaw, MI (US)

(73) Assignee: Eaton Corporation, Cleveland, OH (US)

( * ) Notice: Subject to any disclaimer, the term of this patent is extended or adjusted under 35 U.S.C. 154(b) by 437 days.

(21) Appl. No.: 12/777,573

(22) Filed: May 11, 2010

(65) Prior Publication Data

US 2011/0277715 A1 Nov. 17, 2011

(51) Int. Cl.
*F01L 1/14* (2006.01)

(52) U.S. Cl.
USPC ..... 123/90.52; 123/90.45; 123/90.48

(58) Field of Classification Search
USPC ..... 123/90.45, 90.46, 90.48, 90.52
See application file for complete search history.

(56) References Cited

U.S. PATENT DOCUMENTS

| | | | | |
|---|---|---|---|---|
| 2,681,644 | A | 6/1954 | Purchas, Jr. et al. | |
| 4,083,334 | A | 4/1978 | Roncon | |
| 4,227,495 | A | 10/1980 | Krieg | |
| 4,367,701 | A | 1/1983 | Buente | |
| 4,463,714 | A | 8/1984 | Nakamura | |
| 4,807,576 | A * | 2/1989 | Sonoda et al. | 123/90.57 |
| 4,903,651 | A | 2/1990 | Matsuura et al. | |
| 4,904,230 | A | 2/1990 | Kawashima et al. | |
| 5,509,385 | A | 4/1996 | LaVieri | |
| 5,515,819 | A | 5/1996 | Groh et al. | |
| 5,706,771 | A | 1/1998 | Van Heyningen et al. | |
| 5,706,773 | A | 1/1998 | Dura et al. | |
| 5,855,191 | A | 1/1999 | Blowers et al. | |
| 5,901,676 | A | 5/1999 | Edelmayer | |
| 6,325,034 | B1 | 12/2001 | Edelmayer | |
| 6,386,421 | B1 | 5/2002 | Anderson et al. | |
| 6,735,997 | B2 | 5/2004 | Rosenberger et al. | |
| 6,871,622 | B2 * | 3/2005 | Mandal et al. | 123/90.52 |
| 6,964,251 | B2 | 11/2005 | Mandal et al. | |

(Continued)

FOREIGN PATENT DOCUMENTS

| | | | |
|---|---|---|---|
| DE | 102004032240 | A | 2/2006 |
| JP | S5888412 | A | 5/1983 |
| JP | S59209440 | A | 11/1984 |
| JP | H01216007 | A | 8/1989 |

OTHER PUBLICATIONS

European Search Report for European Application No. 11165519.7 dated Aug. 22, 2011.

(Continued)

*Primary Examiner* — Ching Chang
(74) *Attorney, Agent, or Firm* — Remarck Law Group PLC

(57) ABSTRACT

A cold-formed flat top plunger blank is provided for use in a hydraulic lash adjuster. An end wall at the first end of the plunger body defines a flat top surface that is cold-formed to final dimensions or net shape. The flat top surface at the first end of the plunger body is configured to engage a flat surface within the mating bore of an engine cylinder head. By configuring the plunger body to have a flat top surface that engages a flat surface disposed within the mating bore of an engine cylinder head, the force applied to the engine block by the lash adjuster is distributed more evenly, minimizing wear. The external flat top plunger is a unitary component cold-formed to near net shape, including cold-forming to final dimensions the flat top surface and a counterbore.

14 Claims, 5 Drawing Sheets

(56) References Cited

U.S. PATENT DOCUMENTS

| | | | |
|---|---|---|---|
| 7,013,857 | B2 | 3/2006 | Williams et al. |
| 7,025,025 | B2 | 4/2006 | Mandal et al. |
| 7,028,654 | B2 | 4/2006 | Mandal et al. |
| 7,032,553 | B2 | 4/2006 | Williams et al. |
| 7,047,925 | B2 | 5/2006 | Hendriksma et al. |
| 7,069,891 | B2 | 7/2006 | Mandal et al. |
| 7,128,034 | B2 | 10/2006 | Mandal et al. |
| 7,191,745 | B2 | 3/2007 | Mandal et al. |
| 7,207,302 | B2 | 4/2007 | Williams et al. |
| 7,273,026 | B2 | 9/2007 | Mandal et al. |
| 7,281,329 | B2 | 10/2007 | Mandal et al. |
| 7,284,520 | B2 | 10/2007 | Mandal et al. |
| 7,293,540 | B2 | 11/2007 | Mandal et al. |
| 7,322,324 | B2 | 1/2008 | Hara et al. |
| 7,350,491 | B2 | 4/2008 | Stretch et al. |
| 2006/0016405 | A1 | 1/2006 | Harris et al. |
| 2007/0157898 | A1 | 7/2007 | Mandal et al. |
| 2007/0193544 | A1 | 8/2007 | Mandal et al. |
| 2007/0214639 | A1 | 9/2007 | Mandal et al. |
| 2008/0277034 | A1 | 11/2008 | Roth |
| 2009/0044775 | A1 | 2/2009 | Tallio et al. |
| 2010/0071649 | A1 | 3/2010 | Janowiak |

OTHER PUBLICATIONS

British Search Report for British Application No. GB1207977.8 dated Aug. 6, 2012.

* cited by examiner

COLD-FORMED FLAT TOP PLUNGER FOR USE IN A HYDRAULIC LASH ADJUSTER AND METHOD OF MAKING SAME

FIELD OF THE INVENTION

The present disclosure is directed to a flat-faced plunger for use in a hydraulic lash adjuster and a method of manufacturing the flat-faced plunger.

BACKGROUND

Hydraulic lash adjusters (also sometimes referred to as "lifters") for internal combustion engines have been in use for many years to eliminate clearance (or "lash") between engine valve train components under varying operating conditions, in order to maintain efficiency and to reduce noise and wear in the valve train. Hydraulic lash adjusters regulate the transfer of energy from the valve actuating cam to the valves through hydraulic fluid trapped in a pressure chamber in the plunger. During each operation of the cam, as the length of the valve actuating components varies as a result of temperature changes and wear, small quantities of hydraulic fluid are permitted to enter the pressure chamber, or escape therefrom, thus effecting an adjustment in the length of the lash adjuster, and consequently adjusting the effective total length of the valve train. In certain applications, the overall length is adjusted by configuring the rocker arm of the valve train to pivot on the lash adjuster.

Lash adjusters often incorporate subassemblies of multiple components, including plungers. Minimizing the number of components in a subassembly reduces the amount of time and resources required to assemble the lash adjuster.

SUMMARY

In one embodiment, a cold-formed plunger blank for use in a hydraulic lash adjuster has a unitary cold-formed plunger body. The cold-formed plunger body includes an end wall having a flat top surface. A side wall extending along the longitudinal axis between a first end and a second end defines a generally cylindrical outer surface and a first generally cylindrical interior surface. A shoulder extending from the first generally cylindrical interior surface defines a retainer receiving surface, a ball seat surface, and a first transition surface that joins the ball seat surface with the first generally cylindrical interior surface. The end wall, the side wall, and at least a portion of the shoulder define a cavity. A counterbore extending from the second end toward the first end is defined at least in part by a second generally cylindrical interior surface formed in the side wall and the retainer receiving surface of the shoulder.

In another embodiment, a method of cold-forming a flat-top plunger blank for use in a hydraulic lash adjuster is provided. The method includes the steps of providing a metal slug having first and second ends. The method further includes extruding the slug at its first end to form a cavity that is defined by an end wall at the second end and side wall extending from the first end to the second end, forming a flat plunger end surface on the end wall of the slug to final dimensions, upsetting at least a portion of the side wall at the first end to form a shoulder that at least partially encloses the cavity, and forming the shoulder to final dimensions.

In another embodiment, a method of manufacturing a cold-formed flat top plunger using a cold-forming machine having a cutoff station and five forming stations is provided. The method includes the steps of shearing a wire at the cutoff station to a desired length to form a slug having first and second ends, squaring the first and second ends of the slug and forming an indentation in the second end of the slug at the first forming station, extruding the slug at its second end to form a first bore that is defined by a cylindrical wall and an end wall at the second station, and punching through the end wall of the slug at the third forming station to form a hole having a diameter smaller than a diameter of the first bore. The method further includes upsetting at least a portion of the cylindrical wall at the first end to form a shoulder that at least partially defines a cavity and forming a flat surface on the end wall at the fourth forming station. At the fifth forming station, the shoulder is coined to final dimensions and a channel is formed to final dimensions in the first flat surface.

BRIEF DESCRIPTION OF THE DRAWINGS

It will be appreciated that the illustrated boundaries of elements in the drawings represent only one example of the boundaries. One of ordinary skill in the art will appreciate that a single element may be designed as multiple elements or that multiple elements may be designed as a single element. An element shown as an internal feature may be implemented as an external feature and vice versa.

Further, in the accompanying drawings and description that follow, like parts are indicated throughout the drawings and description with the same reference numerals, respectively. The figures may not be drawn to scale and the proportions of certain parts have been exaggerated for convenience of illustration.

DETAILED DESCRIPTION

Figure 1:
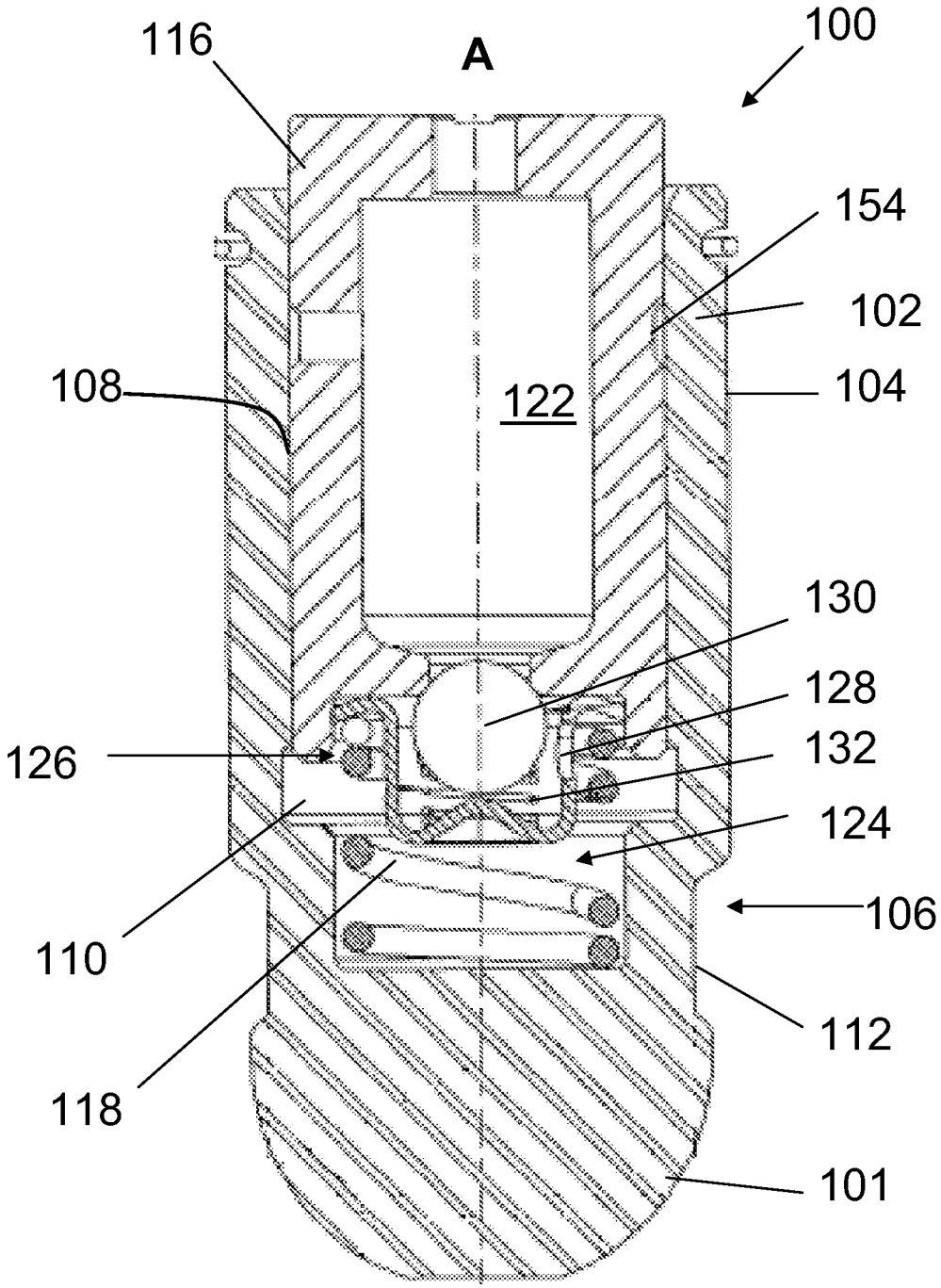
FIG. 1 illustrates a cross-sectional view of an exemplary hydraulic lash adjuster 100 incorporating an external flat top plunger 116.

Certain terminology will be used in the following description for convenience in reference only and will not be limiting. The terms "upward," "downward," "upper," and "lower" will be understood to have their normal meanings and will refer to those directions as the drawing figures are normally viewed.

The present disclosure is directed to a cold-formed flat top plunger for use in a hydraulic lash adjuster. The external flat top plunger is of a one-piece construction incorporating features previously provided by subcomponents combined with the plunger, such as a shim and/or seal. The external flat top plunger is cold-formed to near net shape, requiring a reduced amount of machining to complete the finished part as compared to prior art plungers.

FIG. 1 illustrates a cross-sectional view of an exemplary hydraulic lash adjuster 100. The hydraulic lash adjuster 100 is shown by way of example only and it will be appreciated that the external flat top plunger employed therein can be used in any configuration of a hydraulic lash adjuster and is not limited to the configuration of the hydraulic lash adjuster 100 illustrated in FIG. 1. The structure and operation of hydraulic lash adjusters of the type shown in FIG. 1 is known to those skilled in the art.

As shown in FIG. 1, the hydraulic lash adjuster 100 includes a lash adjuster body 102 that is configured to be disposed within a mating bore (not shown) in an engine cylinder head (not shown). The lash adjuster body 102 extends along longitudinal axis A and includes a first generally cylindrical exterior lash adjuster surface 104, a groove 106, a ball portion 101, and an interior surface 108 that defines a lash adjuster cavity 110. The groove 106 is at least partially defined by a second generally cylindrical exterior lash adjuster surface 112 that has an outer diameter that is less than the outer diameter of the first generally cylindrical exterior lash adjuster surface 104.

The hydraulic lash adjuster 100 also includes an external flat top plunger 116 disposed in the lash adjuster cavity 110. The external flat top plunger 116 and lash adjuster body 102 are configured for reciprocal movement relative to one another along the longitudinal axis A. A plunger spring 118 is disposed within the lash adjuster cavity 110 underneath the external flat top plunger 116 and is configured to bias the external flat top plunger 116 in an upward direction relative to the lash adjuster body 102. During engine operation, the plunger spring 118 acts to maintain engagement of the ball portion 101 with the rocker arm (not shown) of the valve train (not shown). To limit movement of the lash adjuster 100 relative to engine cylinder head (not shown), a retaining member 120, such as a retaining ring or washer, is provided adjacent the upper portion of the body 102.

With continued reference to FIG. 1, the external flat top plunger 116 itself defines a low pressure fluid chamber 122, while the lash adjuster body 102 and the lower portion of the external flat top plunger 116 cooperate with each other to define a high pressure fluid chamber 124 within the lash adjuster cavity 110 of the lash adjuster body 102. To control fluid flow between the low pressure fluid chamber 122 and the high pressure fluid chamber 124, the hydraulic lash adjuster 100 includes a check valve assembly 126 positioned between the plunger spring 118 and the lower portion of the external flat top plunger 116. The check valve assembly 126 functions to either permit or block fluid communication between the low pressure fluid chamber 122 and the high pressure fluid chamber 124, in response to the pressure differential between the two fluid chambers 122, 124.

As shown in FIG. 1, the check valve assembly 126 includes a retainer 128 that is in engagement with a lower portion of the external flat top plunger 116, a check ball 130, and a check ball spring 132 that is disposed between the retainer 128 and the check ball 130. The check ball spring 132 is configured to bias the check ball 130 in an upward direction toward the external flat top plunger 116, and is therefore commonly referred to by those skilled in the art as a "normally biased closed" check valve assembly.

Figure 2:
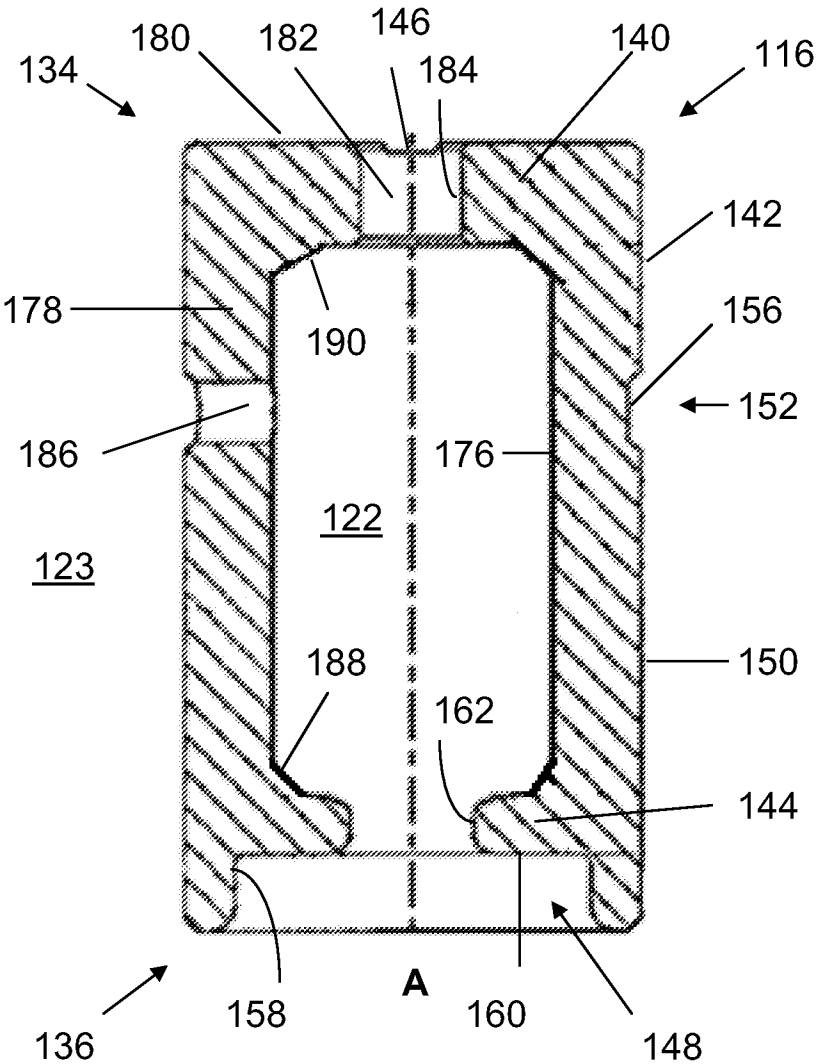
FIG. 2 illustrates a detailed cross-sectional view of one embodiment of an external flat top plunger 116 for use in the exemplary hydraulic lash adjuster 100.

FIG. 2 is a detailed cross-sectional view of the external flat top plunger 116 employed in the exemplary hydraulic lash adjuster 100 illustrated in FIG. 1. It will be appreciated that the external flat top plunger 116 illustrated in FIGS. 1 and 2 is shown by way of example only and the external flat top plunger claimed herein is not limited to the configuration shown in these drawings.

With reference to FIG. 2, the external flat top plunger 116 is a generally cylindrical member comprising a plunger body 142 having a first end 134 and a second end 136, a side wall 178 that extends along the longitudinal axis A, and an end wall 140 at the first end 134 of the plunger body 142 defining a flat top surface 180, the end wall 140 extending transversely to the longitudinal axis A at the first end 134 of the plunger body 142. The flat top surface 180 at the first end 134 of the plunger body 142 is configured to engage a flat surface within the mating bore of an engine cylinder head. By configuring the plunger body 142 to have a flat top surface 180 that engages a flat surface disposed within the mating bore of an engine cylinder head, the force applied to the engine block by the lash adjuster 100 is distributed more evenly, minimizing wear to both the engine block and the lash adjuster 100, and in particular the flat top surface 180. In the configuration shown in FIG. 2, the flat top surface is located on either side of a shallow channel 146 and an end wall bore 182 that is defined by bore side wall 184. The flat top surface 180 may also be substantially flat across the entire first end 134 of the plunger body 142, uninterrupted by, for example, the shallow channel 146 and end wall bore 182.

The side wall 178 defines a generally cylindrical exterior plunger surface 150 and a groove 152 formed in the generally cylindrical exterior plunger surface 150. The groove 152 cooperates with the interior surface 108 of the lash adjuster body 102 to form a fluid collector channel 154, shown in FIG. 1, and is at least partially defined by a second generally cylindrical exterior surface 156 that has an outer diameter that is less than the outer diameter of the generally cylindrical exterior plunger surface 150.

With continued reference to FIG. 2, the plunger body 142 includes a counterbore 148 configured to receive the check valve assembly 126. The counterbore 148 is defined by a generally cylindrical second interior side surface 158, and a flat annular surface 160 of the shoulder 144, the flat annular surface 160 being generally perpendicular to the axis A and extending from the second cylindrical interior surface 158, and a rounded annular surface 162 of the shoulder 144 that extends from the flat annular surface 160. The flat annular surface 160 is sized to receive the retainer 128 of the check valve assembly 126. The rounded annular surface 162 is sized to receive the check ball 130 of the check valve assembly 126, such that the check ball 130 engages the rounded annular surface 162 creating a fluid impermeable seal between the check ball 130 and the rounded annular surface 162 as shown in FIG. 1. Hence, the rounded annular surface 162 may also be referred to herein as the "ball seat 162" or the "ball seat surface 162." The check ball 130 of the check valve assembly 126 sits in the check ball seat 162 defined by the shoulder 144, separating the low pressure oil chamber 122 from the high pressure chamber 124 opposite the check ball 130. During normal operation, the check ball 130 allows fluid to pass when the oil pressure in the low pressure chamber 122 reaches a sufficient level relative to the oil pressure in the high pressure chamber 124. Although the ball seat surface 162 in the illustrated embodiment of the external flat top plunger 116 is a rounded annular surface, it will be appreciated that the ball seat surface 162 can be an annular frusto-conical surface or any other desired shape so long as an appropriate seal is created between the check ball 130 and the ball seat surface 162.

Generally, the low pressure fluid chamber 122 is surrounded by a generally cylindrical first interior surface 176. A plunger fluid port 186 extends radially through the side wall 178 and provides fluid communication between the outside of the plunger 123 and the fluid chamber 122. The fluid chamber 122 is also defined by a first transition surface 188 on the underside of the shoulder 144 that creates a transition from the ball seat surface 162 to fluid chamber 122 and a second transition surface 190 that creates a transition from the first cylindrical interior surface 176 to the end wall bore 182 that is defined by the bore side wall 184. In the embodiment shown in FIG. 2, the first transition surface 188 and second transition surface 190 are frusto-conical surfaces. It will be appreciated that each of these transition surfaces can additionally form, for example, an annular surface that is generally perpendicular to the axis A, a convex curved surface, or the frusto-conical surface shown, or any combination thereof.

Figure 3:
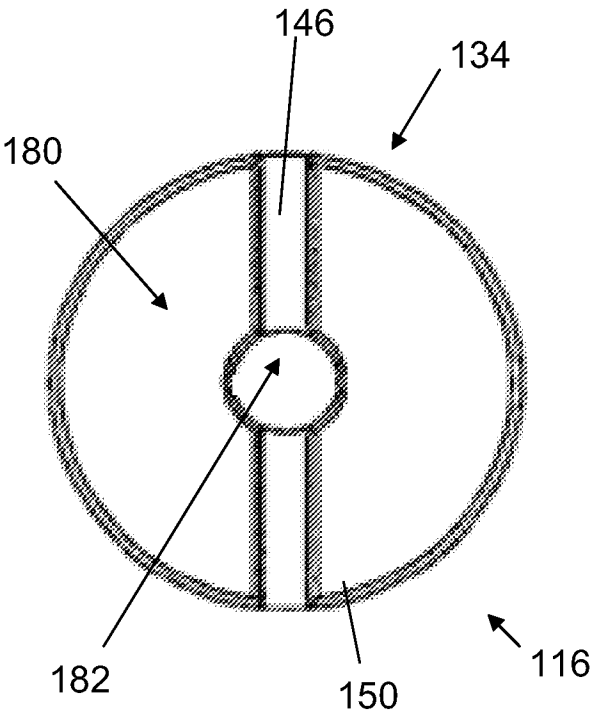
FIG. 3 illustrates a top view of one embodiment of an external flat top plunger 116.

FIG. 3 is a top view of the external flat top plunger 116 showing the first end 134 having the flat top surface 180. The shallow channel 146 extends across the first end 134, overlapping the end wall bore 182. The shallow channel 146 functions to allow a small amount of oil and any air out of the low pressure fluid chamber 122. Different configurations of the shallow channel 146 are permissible. For example, a configuration with two channels 146 formed in a crossing relationship may be desirable. Such an arrangement would permit narrower channels 146 and could increase the surface area of the flat top surface 180 and thereby further minimize wear to both the engine block and the lash adjuster 100, and in particular the flat top surface 180.

Figure 4:
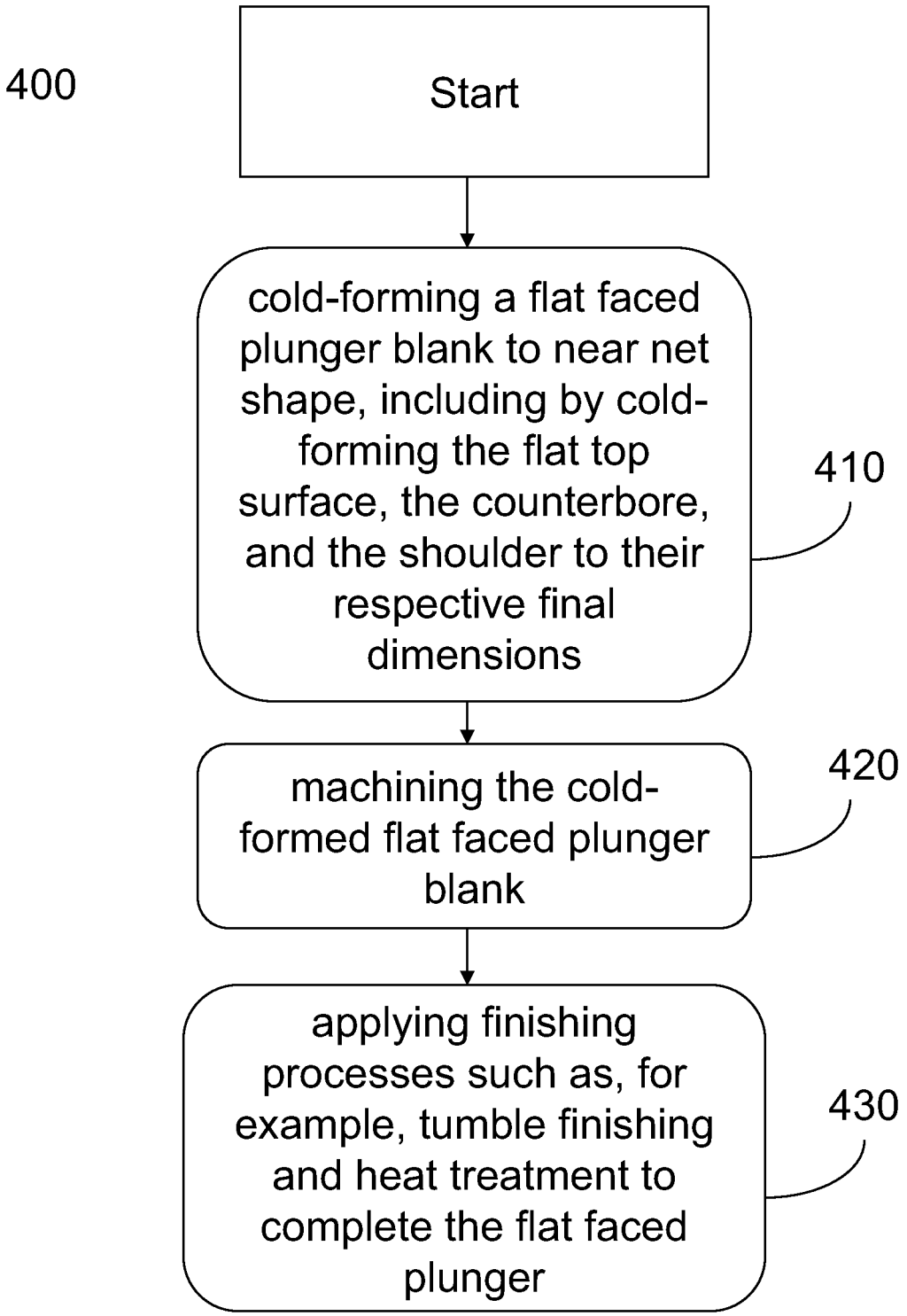
FIG. 4 illustrates an example method 400 of producing the external flat top plunger 116 described above and illustrated in FIGS. 1 and 2.

Illustrated in FIG. 4 is an example method 400 of producing the external flat top plunger 116 described above and illustrated in FIGS. 1 and 2. As shown in FIG. 4, the method 400 includes two general steps—i) cold-forming an external flat top plunger blank to near net shape, including by cold-forming the flat top surface 180, the counterbore 148, and the shoulder 144 to their respective final or net shape dimensions (step 410), ii) machining the cold-formed flat top plunger blank (step 420), and iii) applying finishing processes such as, for example, tumble finishing and heat treatment to complete the external flat top plunger 116 (step 430). As used herein, the terms final dimensions or net-shape dimensions are intended to encompass manufacture to the final set of dimensions of the workpiece or feature thereof, while still permitting further processing of the workpiece that does not alter in a significant way the final dimensions of the workpiece, such as polishing, tumble finishing, heat treatment, or other processes. Each of these finishing processes may, in a strict sense, have an effect on the dimensions of the workpiece, but as a practical matter function to provide surface finishes to a workpiece already manufactured to its final dimensions. The terms near final dimensions or near net-shape dimensions are intended to encompass manufacture where many or almost all dimensions of the workpiece or feature thereof are complete, but may still require one or more machining or cold-forming processes to add or alter a dimension of the workpiece or dimension thereof.

As used herein, the term "cold-forming" is intended to encompass what is known in the art as, for example, "cold forging," "cold heading," and "deep drawing." As used herein, the term "machining" means the use of a chucking machine, drilling machine, turning machine, grinding machine, broaching machine or other such machine to remove material.

Figure 5:
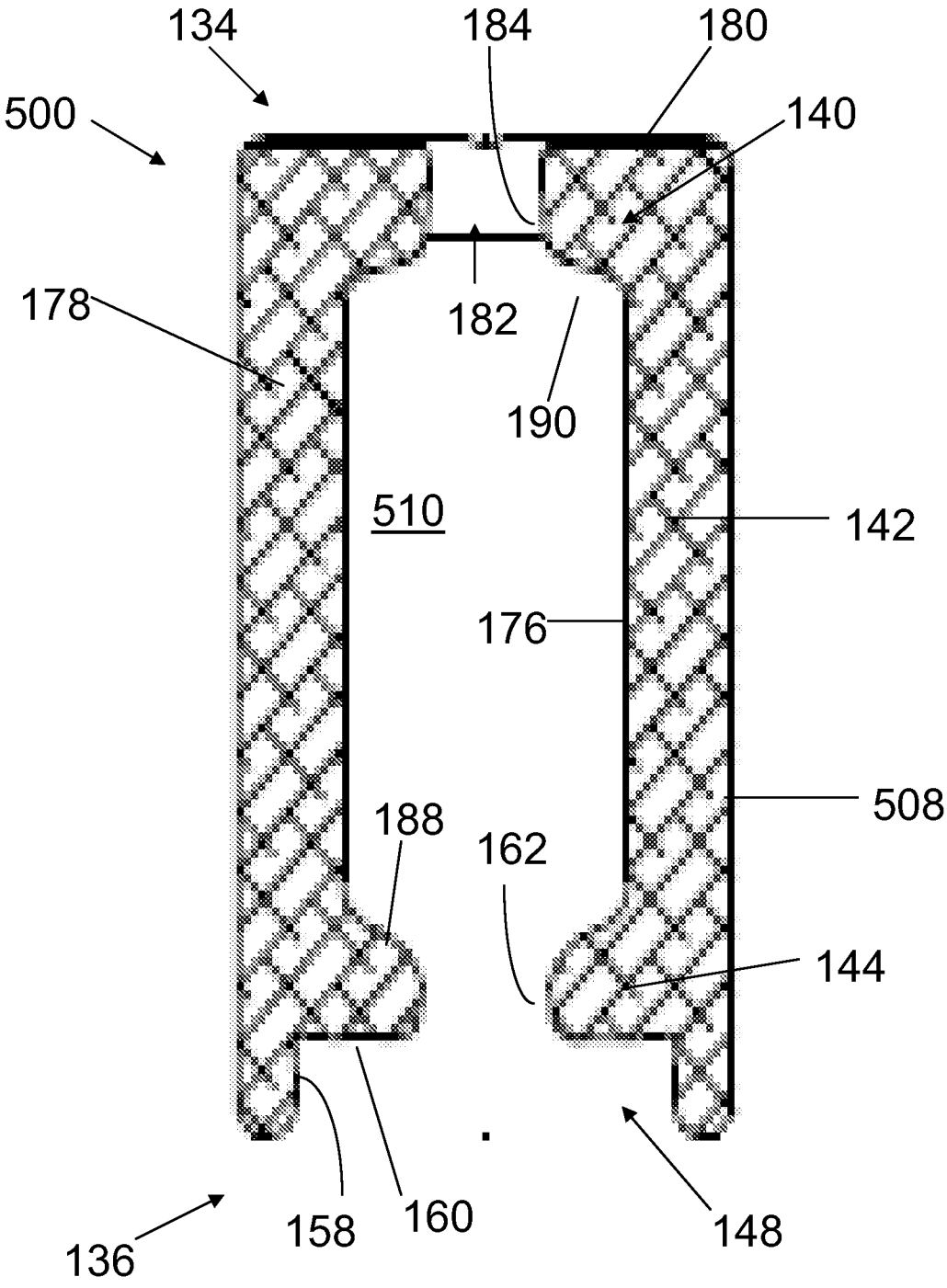
FIG. 5 illustrates a cross-sectional view of one embodiment of a cold-formed flat top plunger blank 500 following the cold-forming step (step 410) described in FIG. 4.

Illustrated in FIG. 5 is a cross-sectional view of one embodiment of a cold-formed flat top plunger blank 500 that is the result of the cold-forming step (step 410) described above. As shown in FIG. 5, the cold-formed flat top plunger blank 500 is near net shape as compared to the finished flat top plunger 116. As shown in FIG. 5, the external flat top plunger blank 500, which has been cold-formed to near net shape, includes a first end 134, a second end 136, and a side wall 178 extending along a longitudinal axis A. The first end 134 has an end wall 140 defining a flat top surface 180 that has been cold-formed to net shape. The end wall 140 is pierced during the cold-forming operation to form the wall bore 182 defined by bore side wall 184 and extending through the end wall 140.

The cold-formed flat top plunger blank 500 includes a counterbore 148 and a generally cylindrical exterior surface 508, which differs from the generally cylindrical exterior plunger surface 150 in that no groove 152 or plunger fluid port 186 has yet been machined into the side wall 178. The counterbore 148 is defined by a second cylindrical interior surface 158 and a flat annular surface 160 that partially defines the shoulder 144. The flat annular surface 160 is generally perpendicular to the axis A and extends from the second cylindrical interior surface 158 (also referred to as the "retainer receiving surface 160"). A rounded annular surface 162 (also referred to as the "ball seat 162" or the "ball seat surface 162") extends from the retainer receiving surface 160.

With continued reference to FIG. 5, disposed within the cold-formed flat top plunger blank 500 is an axially extending bore or cavity 510 corresponding to the low pressure fluid chamber 122 formed between the end wall 140 and the shoulder 144. The shoulder 144 is formed between the cavity 510 and the counterbore 148, and is defined by the flat annular surface 160, the ball seat surface 162, and the first transition surface 188. The cavity 510 is defined by a first cylindrical interior surface 176, the first transition surface 188, and second transition surface 190. The first transition surface 188 transitions the ball seat surface 162 to the first cylindrical interior surface 176, and a second transition surface 190 transitions the first cylindrical interior surface 176 to the bore side wall 184. It will be appreciated that each of these transition surfaces may additionally form, for example, an annular surface that is generally perpendicular to the axis A, a convex curved surface, the frusto-conical surface shown, or any combination thereof.

The cold-formed flat top plunger blank 500 may be formed in a variety of cold-forming machines. Suitable examples of cold-forming machines that can be used to form the cold-formed flat top plunger blank 500 include Waterbury and National Machinery cold-forming machines. The cold-formed flat top plunger blank 500 may be formed from a variety of materials suitable for cold-forming, such as Society of Automotive Engineers ("SAE") grade 1018 steel or grade 1522 steel. Generally, cold-forming machines include a cut-off station for cutting metal wire to a desired length to provide an initial workpiece (also known as a "slug") and multiple progressive forming stations that include multiple spaced-apart die sections and a reciprocating gate having multiple punch sections, each of which cooperates with a respective die section to form a die cavity. A conventional transfer mechanism moves the slug in successive steps from the cut-off station to each of the forming stations in a synchronized fashion and is also capable of rotating the slug 180 degrees as it is being transferred from one station to another. As cold-forming machines are well known in the art, no further description is necessary.

In one embodiment, the cold-formed flat top plunger blank 500 is formed in a five station cold-forming machine (not shown). It will, however, be appreciated that the cold-formed flat top plunger blank 500 can be produced in a different number of forming stations without departing from the scope of the invention.

Illustrated in FIGS. 6A-6F is an exemplary cold-forming five-station slug progression sequence that can be used to form the cold-formed flat top plunger blank 500. Each figure represents the state of the slug at an end-of-stroke tool position. It will be appreciated that this slug progression sequence is merely one example of a cold-forming slug progression sequence and that other slug progression sequences are possible.

Figure 6A:
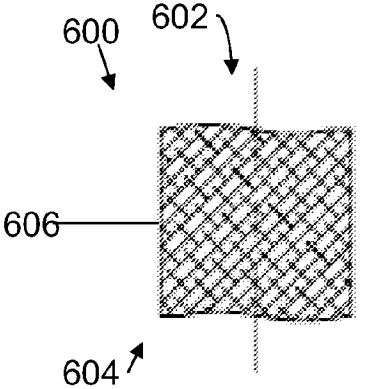
FIGS. 6A-6F illustrates an exemplary cold-forming, five station slug progression sequence that can be used to form the cold-formed flat top plunger blank 500.

The exemplary slug progression sequence begins with shearing wire to a desired length at the cut-off station to provide an initial slug 600, which will be described with reference to a first end 602, a second end 604, and a cylindrical surface 606 that extends therebetween as shown in FIG. 6A. At this stage, the ends of the slug 600 may have irregularities or unevenness inherent in the shearing process. The slug 600 is then transferred to the first forming station where its first end 602 faces the die section and its second end 604 faces the punch section.

Figure 6B:
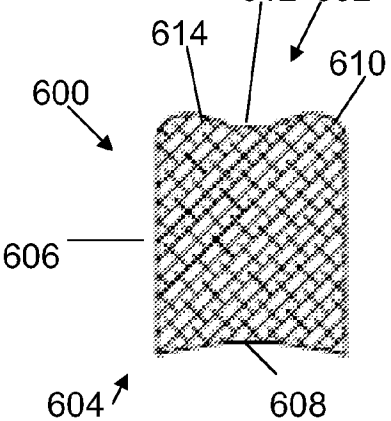

At the first forming station, the slug 600 is squared at the first end 602 and second end 604 and a slight indentation 608 is formed in the second end 604 at the punch section of the cold-forming machine, as shown in FIG. 6B. At the die section of the cold-forming machine, a chamfer 610 is simultaneously formed between the first end 602 and the cylindrical surface 606 of the slug 600. Additionally, at the die section, another indentation 612 is formed in the first end 602 of the slug 600 along with a chamfer 614 formed adjacent the indentation 612 at the first end 602. The indentation 612 helps center and guide the punch from the second forming station, which will be described in further detail below. The slug 600 is then rotated 180 degrees end-to-end and transferred to the second forming station where its first end 602 faces the punch section and its second end 604 faces the die section.

Figure 6C:
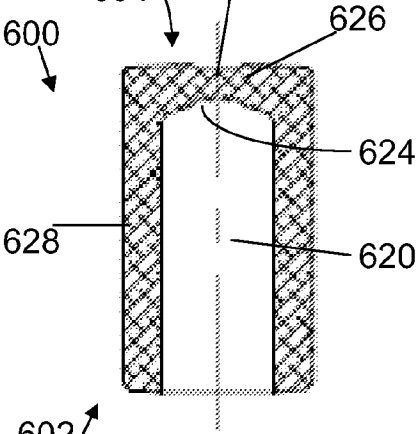

At the second forming station, a first bore 620, corresponding to the cavity 510 of the final blank, is backward extruded through the first end 602 of the slug 600 at the punch section of the cold-forming machine, as shown in FIG. 6C. The first bore 620 is partially surrounded by the end wall 626 and side wall 628. Simultaneously, at the die section of the cold-forming machine, a first indentation 622 and second indentation 624 are formed on either side of the end wall 626 at the second end 604 of the blank 600. The first indentation 622 helps center and guide the punch from the fourth forming station and reduces the thickness of the material between the two indentations 622 and 624, while the second indentation 624 narrows the thickness of the material between first indentation 622 and second indentation 624, which is removed at the fourth station. The portion of the end wall 636 between the first indentation 622 and second indentation 624 is later pierced to create the hole in the end wall 626 that will eventually form the end wall bore 182. The slug 600 is then transferred to the third forming station where its second end 604 faces the die section and its first end 602 faces the punch section.

Figure 6D:
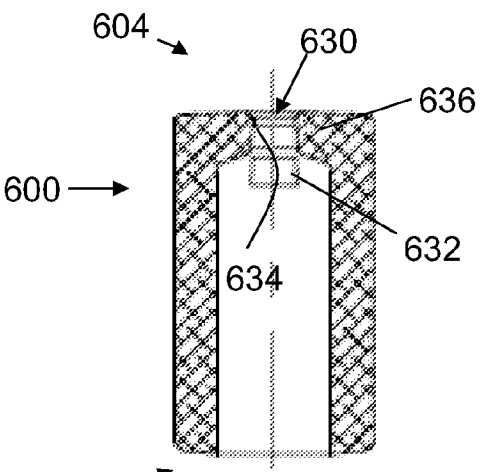

As shown in FIG. 6D, at the third forming station, a hole 630 defined by side wall 634 is punched through the center of the end wall 636, removing punched material 632. The hole 630 will become the end wall bore 182. The slug 600 is then rotated 180 degrees and transferred to the fourth forming station where its second end 604 faces the punch section and its first end 602 faces the die section.

Figure 6E:
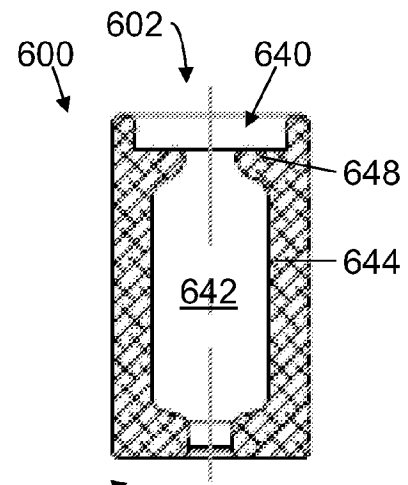

As shown in FIG. 6E, a counterbore 640, corresponding to the counterbore 148 on the completed slug, is formed at the first end 602 of the slug 600 by the die section of the cold-forming machine. The counterbore 640 has a diameter greater than that of the cavity 642. Due to this size difference, the die that forms the counterbore 640 upsets the wall 644 surrounding the cavity 642, thereby preliminarily forming the shoulder 648 that will define the retainer receiving surface 160 and the ball seat surface 162 in the final cold-formed blank 500. The slug 600 is then rotated 180 degrees and transferred to the fifth forming station where its first end 602 faces the punch section and its second end 604 faces the die section.

Figure 6F:
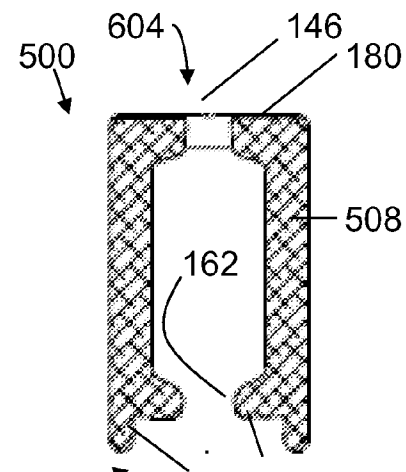

At the fifth forming station, as shown in FIG. 6F, the slug 600 is formed to its final dimensions, including forming of the shallow channel 146 being formed to its final dimensions. In addition, the second cylindrical interior surface 158, the retainer receiving surface 160, the ball seat surface 162, and cylindrical exterior surface 508 are formed to their respective final dimensions. Additionally, any potential sharp corners, such as at the outer edges of the first end 602 and second end 604, may be formed to create chamfers smoothing such breaks. The overall length of the slug 600 may be formed to the length of the blank 500, and the first end 602, in particular the flat top surface 180, and second end 604 are formed to their final shape in a coining step. Further, the outer diameter of the cylindrical exterior surface 508 is formed to its final dimensions. At the conclusion of the fifth forming station, the cold-formed flat top plunger blank 500 is completed and includes all of the structural features shown in FIG. 5.

The cold-formed flat top plunger blank 500 includes all of the structural features of the finished flat top plunger 116 described above and illustrated in FIGS. 1 and 2, with the exception of the structural features that must be machined. To complete the method 400 of producing the finished flat top plunger 116 described above and illustrated in FIGS. 1 and 2, the cold-formed flat top plunger blank 500 is machined after cold-forming to form the remaining structural features as discussed above and shown in FIG. 2.

The machining step (step 420) is performed on the completed blank 500. With reference to FIGS. 2 and 5, the groove 152 is machined into the generally cylindrical exterior surface 508. Additionally, the plunger fluid port 186 is machined into the side wall 178. It will be appreciated that these machining operations can be performed one at a time, in combination with one or more other machining operations, or all together in any sequence.

The external flat top plunger 116 described above is cold-formed to near net shape, including cold forming to final dimensions the flat top surface 180 and the counterbore 148 defined by the second cylindrical interior side surface 158, the flat annular surface 160 of the shoulder 144, and the rounded annular surface 162 of the shoulder 144 that extends from the flat annular surface 160. Cold-forming these features to final dimensions reduces the amount of machining otherwise required to complete a finished flat top plunger and thus reduces manufacturing cost of the finished ball plunger. Additionally, when compared to plunger designs that require the use of a seat insert and seal, these parts along with the associated assembly time and costs are eliminated.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or multiple components. As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about X to Y is intended to mean from about X to about Y, where X and Y are the specified values.

While the present disclosure illustrates various embodiments, and while these embodiments have been described in some detail, it is not the intention of the applicant to restrict or in any way limit the scope of the claimed invention to such detail. Additional advantages and modifications will readily appear to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing embodiments are illustrative, and no single feature or element is essential to all possible combinations that may be claimed in this or a later application.

The invention claimed is:

1. A method of cold forming a flat-top plunger blank for use in a hydraulic lash adjuster comprising the steps of:

providing a metal slug having first and second ends;

extruding the metal slug at its first end to form a cavity that is defined by an end wall at the second end and side wall extending from the first end to the second end, the cavity defining a first inner diameter at the side wall;

forming a flat plunger end surface on the end wall of the metal slug to final dimensions;

upsetting at least a portion of the side wall at the first end to form a counterbore and a shoulder that at least partially encloses the cavity, the counterbore having a second inner diameter that is greater than the first inner diameter, wherein the shoulder defines a retainer receiving surface and a ball seat surface; and forming the shoulder to final dimensions.

2. The method of cold-forming a flat top-plunger blank for use in a hydraulic lash adjuster of claim 1, wherein the providing step includes shearing wire to a desired length to form the metal slug.

3. The method of cold-forming a flat-top plunger blank for use in a hydraulic lash adjuster of claim 1, further comprising the step of squaring the first and second ends of the metal slug before the extruding step.

4. The method of cold-forming a flat-top plunger blank for use in a hydraulic lash adjuster of claim 1, further comprising the step of forming a first indentation in the first end of the metal slug and a second indentation in the second end of the metal slug after the providing step and before the extruding step.

5. The method of cold-forming a flat-top plunger blank for use in a hydraulic lash adjuster of claim 1, further comprising forming the flat-top plunger blank to final length after the extruding step.

6. The method of cold-forming a flat-top plunger blank for use in a hydraulic lash adjuster of claim 1, further comprising forming the side wall to final dimensions after the extruding step.

7. The method of cold-forming a flat-top plunger blank for use in a hydraulic lash adjuster of claim 1, further comprising forming the shoulder to final dimensions after the extruding step.

8. The method of cold-forming a flat-top plunger blank for use in a hydraulic lash adjuster of claim 1, further comprising forming the flat plunger end surface to final dimensions after the extruding step.

9. A method of manufacturing a cold-formed flat top plunger using a cold-forming machine having a cutoff station and five forming stations, the method comprising the steps of:

at the cutoff station, shearing a wire to a desired length to form a slug having first and second ends;

at the first forming station, squaring the first and second ends of the slug and forming an indentation in the second end of the slug;

at the second forming station, extruding the slug at its second end to form a first bore that is defined by a cylindrical wall having a first inner diameter and an end wall;

at the third forming station, punching through the end wall of the slug to form a hole having a diameter smaller than a diameter of the first bore;

at the fourth forming station, upsetting at least a portion of the cylindrical wall at the first end to form a counterbore and a shoulder that at least partially closes the first bore, the counterbore having a second inner diameter that is greater than the first inner diameter, wherein the shoulder defines a retainer receiving surface and a ball seat surface; and at the fifth forming station, coining the shoulder to form the shoulder to final dimensions and forming a channel in a flat surface, on the end wall, the channel and flat surface formed to final dimensions.

10. The method of manufacturing a cold-formed flat top plunger of claim 9, wherein the extruding step comprises backward extruding the slug at its second end to form a first bore that is defined by a cylindrical wall and an end wall.

11. The method of manufacturing a cold-formed flat top plunger of claim 9, further comprising the step of machining a groove in the cylindrical wall having an outer diameter, the groove defined in part by a generally cylindrical surface having a diameter smaller than that of the outer diameter of the cylindrical wall.

12. The method of manufacturing a cold-formed flat top plunger of claim 9, further comprising forming the overall length of the plunger to final dimension at the fifth forming station.

13. The method of manufacturing a cold-formed flat top plunger of claim 9, further comprising forming the cylindrical wall to final dimension at the fifth forming station.

14. The method of manufacturing a cold-formed flat top plunger of claim 9, further comprising heat treating the cold-formed plunger.

* * * * *